United States Patent [19]

Knecht

[11] Patent Number: 4,487,351

[45] Date of Patent: Dec. 11, 1984

[54] APPARATUS FOR FEEDING A WEB MATERIAL PROVIDED WITH REGISTER MARKS

[75] Inventor: Siegfried Knecht, Gevelsberg, Fed. Rep. of Germany

[73] Assignee: Maschinenfabrik Alfred Schmermund GmbH & Co., Gevelsberg, Fed. Rep. of Germany

[21] Appl. No.: 492,610

[22] Filed: May 9, 1983

[30] Foreign Application Priority Data

May 25, 1982 [DE] Fed. Rep. of Germany ..... 3219622

[51] Int. Cl.[3] ..... B65H 23/18

[52] U.S. Cl. ..... 226/37; 226/188

[58] Field of Search ..... 226/2, 3, 27–30, 226/33, 34, 37, 181, 188; 83/401, 436

[56] References Cited

U.S. PATENT DOCUMENTS 1,923,609 8/1933 Black ..... 226/31

3,510,036 5/1970 Lewis, Jr. et al. ..... 226/2

FOREIGN PATENT DOCUMENTS 218608 7/1924 United Kingdom ..... 226/2

*Primary Examiner*—Leonard D. Christian

[57] ABSTRACT

Apparatus for feeding a web of material provided with register marks comprises a rotating delivery device and a sensor which responds to the register marks and provides signals for controlling a feed adjusting device. The sensing point of the sensor is located so as to rotate with the delivery device and be positioned adjacent the web to enable reading of the register marks. The delivery device comprises a pair of rollers of unequal circumference, one of the rollers being driven by a one-way clutch and the other roller being selectively driven by a second clutch which is energized in response to the output of the sensor.

20 Claims, 2 Drawing Figures

APPARATUS FOR FEEDING A WEB MATERIAL PROVIDED WITH REGISTER MARKS

BACKGROUND OF THE INVENTION (1) Field of the Invention

The present invention relates to the handling of sheet material and particularly to the delivery of a continuous web of material provided with register marks to a work station continuously and in synchronism with the operation of the work station apparatus. More specifically, this invention is directed to apparatus for feeding a web of material provided with register marks and especially to apparatus for adjusting the speed of delivery to a work station of an indicia bearing continuous ribbon such that it will be received at the work station with the indicia properly positioned for operation of the work station apparatus. Accordingly, the general objects of the present invention are to provide novel and improved methods and apparatus of such character.

(2) Description of the Prior Art

While not limited thereto in its utility, the present invention is particularly well-suited for use in effecting the delivery of a paper web having a pattern repetitively printed thereon to a work station such as, for example. a cutter which severs the web into individual sheets which are subsequently used for packaging or the like. In such case, the printed matter should preferably be situated as centrally as possible on each of the sheets into which the web is divided. The feeding and cutting operation are, of course, preferably performed continuously and at a high working speed.

As is well-known, it is virtually impossible to continuously feed a web of material, particularly a printed paper web, in such a manner as to avoid some offset, for example slippage, between the feed apparatus and the web. Any such offset will result in a loss of synchronism and, in the case where a repetitive printed pattern is being divided into individual portions, the printed matter will thus not be maintained in the desired position on the individual cut sheets. Accordingly, apparatus for effecting feed correction is necessary. Prior art methods of and apparatus for achieving such feed correction are described in Federal Republic of Germany Published Patent Applications Ser. Nos. 1,461,932 and 2,338,109 and in East German Patent Specification No. 148,043.

The apparatus and techniques of the above-mentioned publications are exemplary of the prior art technique of employing a sensor, a photocell for example, which responds to register marks on the web of moving material. In the prior art the difference in time between the detection of a register mark by the sensor and predetermined timing intervals are measured. A speed adjusting device responsive to deviations in the measured time from a desired value was employed to adjust feed speed so as to remove the offset thereby accomplishing the requisite synchronized feed. The apparatus of the prior art is characterized by comparatively complex circuitry which, due to its complexity, is expensive and of somewhat suspect reliability.

SUMMARY OF THE INVENTION

The present invention overcomes the above-briefly discussed and other deficiencies and disadvantages of the prior art by providing a novel and improved technique for correcting the delivery speed of a web of material provided with register marks such that the web will be fed to a work station in synchronism with the operation of the work station apparatus. The present invention also encompasses apparatus for use in the performance of the aforesaid novel technique and particularly a rotating delivery device with a sensor which responds to register marks on the web of material being handled, the sensor device providing control signals for apparatus which corrects the feed speed. Apparatus in accordance with the present invention is characterized by the location of the point at which the testing for the presence of register marks on a web is performed being rotatable with the rotating delivery device.

In accordance with the preferred embodiment the rotating delivery device of the present invention comprises a pair of unequal circumference rollers. The testing point is located on the smaller of these rollers at the periphery thereof, the smaller roller being driven via a one-way clutch-type mechanism. The roller with the larger circumference is driven by a normally disengaged clutch which is energized in response to the control signals provided by the sensor device. Energization of the normally de-energized clutch will, because of the larger diameter of the feed roller associated therewith, cause the web passing over the smaller circumference roller to "catch up" with the testing point at which time the clutch will be de-energized.

BRIEF DESCRIPTION OF THE DRAWING

The present invention may be better understood and its numerous objects and advantages will become apparent to those skilled in the art by reference to the accompanying drawing wherein like reference numerals refer to like elements in the several figures and in which.

DESCRIPTION OF THE PREFERRED EMBODIMENT

Figure 1:
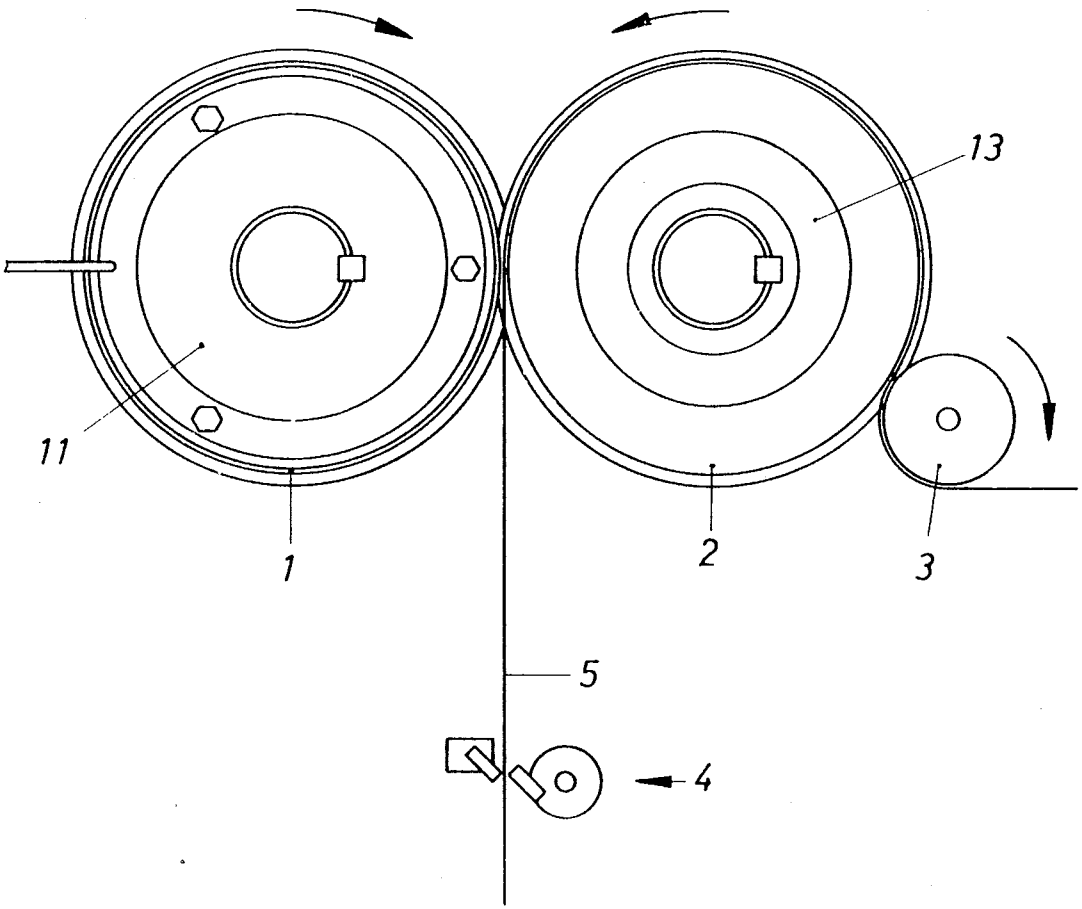
FIG. 1 is a schematic view of a feed system which includes the feed correction device of the present invention.

With reference to FIG. 1, a system for feeding a web of material, indicated at 5, provided with register marks includes a pair of feed rollers 1 and 2 and a deflection roller 3. The direction of rotation of rollers 1, 2 and 3 has been indicated by arrows. The feed system causes delivery of the web 5 to a work station 4 which is disclosed as a cutter. It may be presumed that web 5 bears printed matter, in a repetitive pattern, and the cutting station 4 divides web 5 into individual sheets or portions which, by way of example, will be used for packaging purposes.

The web of material 5, which is typically paper, will pass around the feed roller 2 and will be tensioned by the deflection roller 3. The delivery of web 5 to cutting station 4 will be continuous and at a high working speed. For the purposes which will become apparent from the description below, feed roller 1 will be selected such that its circumference is slightly larger than the spacing between the register marks on web 5. Feed roller 2 will be selected such that its circumference is slightly smaller than the spacing between the register marks on web 5. Feed roller 1 will have a magnetic clutch 11 associated therewith while feed roller 2 will be driven via the freewheel 13 of a one-way clutch mechanism.

Figure 2:
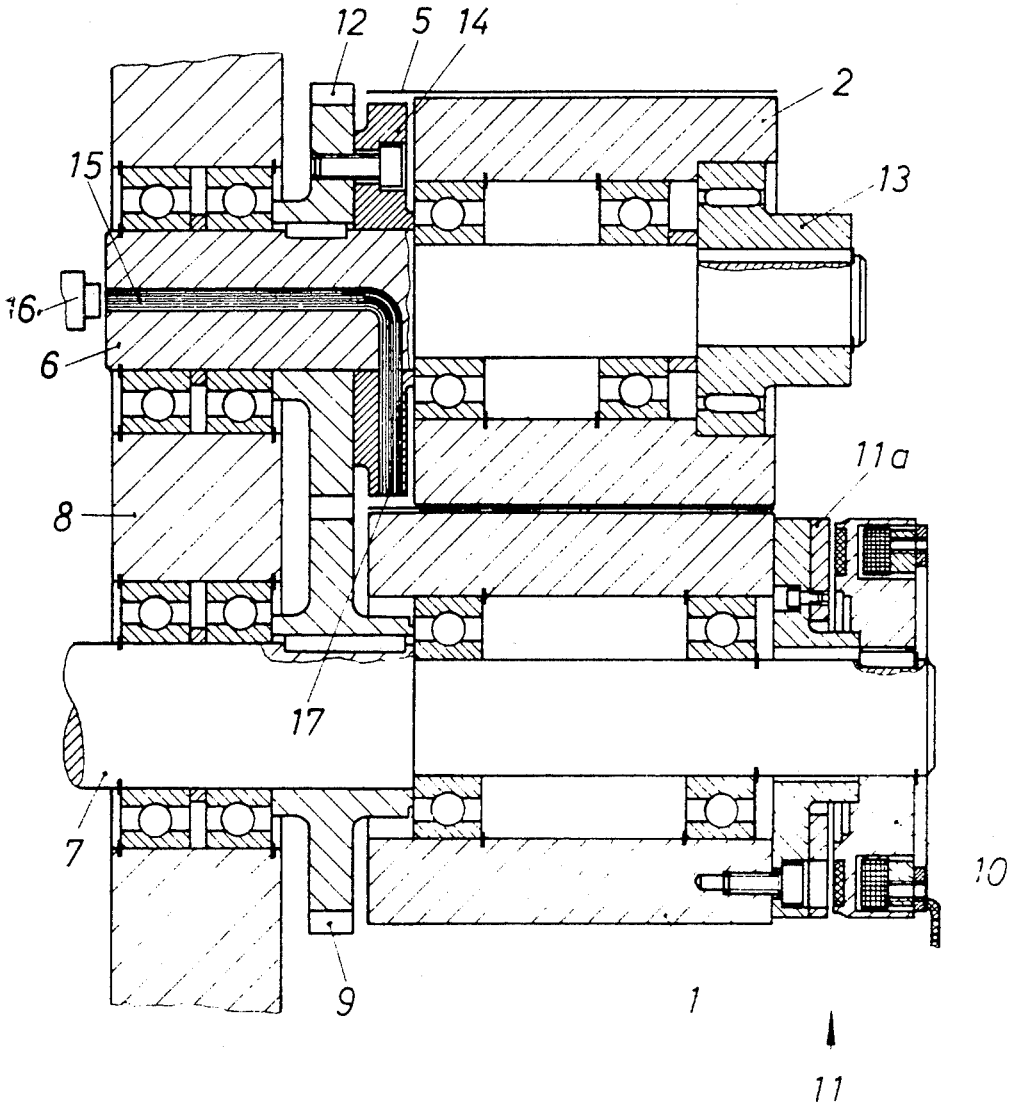
FIG. 2 is a top plan view, partly in section, of an actual feed system of the type shown schematically in FIG. 1, FIG. 2 depicting the sensor and speed adjustment portions of the present invention.

Referring now to FIG. 2 a pair of feed rollers 1 and 2 are respectively supported via bearings on shafts 6 and 7. The shafts 6 and 7 are, in turn, mounted in a pillar 8. Shaft 7 is the drive shaft for the apparatus and has affixed thereto, at a first side of feed roller 1, a drive gear 9. The solenoid subassembly 10 of the magnetic clutch 11 is mounted on shaft 7 at the opposite side of roller 1 from gear 9. The anchor plate 11*a* of clutch 11 is bolted to feed roller 1 as shown. Shaft 7 will be driven by means which has not been illustrated in the drawing.

A driven gear 12, which meshes with gear 9, is affixed to shaft 6. The freewheel 13 of a one-way clutch and a disc 14 are also mounted on shaft 6. The disc 14 is provided with a radially oriented bore which is in registration with the end of the radial portion of an L-shaped bore provided in shaft 6, the leg of this bore being disposed on the shaft axis. A bundle of optical fibers 15 is inserted in the registered bores in shaft 6 and disc 14 such that a first end 17 of the fibers will be disposed at a point, i.e., the testing or sensing point, which is located adjacent the edge of web 5 which extends outwardly from the edge of feed roller 2. A photocell or similar light sensitive device 16 is fixed in position adjacent to and coaxial with shaft 6 so as to be juxtapositioned to the second end of the fiber optic bundle. Accordingly, the fixed position light sensor 16 will view, via the rotating fiber optic bundle 15, the edge of web 5 on which the register marks are provided.

In operation, feed roller 2 is driven from shaft 7 via gears 9 and 12, shaft 6 and freewheel of the one-way clutch 13. As noted above, the diameter of roller 2 is selected such that its circumference is slightly smaller, for example about 2/10 mm, than the spacing of the register marks on web 5. This will result in the length of web 5 which is fed to the cutting station 4 having a tendency to be slightly short for each rotation of feed roller 2. When the pick-up end 17 of fiber optic bundle 15 is situated opposite feed roller 1, as depicted in FIG. 2, the sensor 16 will be turned on. Because the feed of the paper web 5 will be short, for the reason explained above, no register mark will initially be positioned opposite to the end 17 of fiber optic bundle 15 when sensor 16 is energized. The sensor will, accordingly, generate a signal which, through circuitry not shown but well-known in the art, will cause the energization of clutch 11. The "over-size" feed roller 1 will, upon energization of clutch 11, be positively driven and, because the circumference of roller 1 is greater than the web register spacing, the speed of delivery of the web will be increased. Accordingly, on the path between the position opposite to deflection roller 3 and the position opposite to the end 17 of the fiber optic bundle as the apparatus is depicted in FIG. 2, the register mark will "catch up" with the test point of the rotating sensor. When the register mark is aligned with the rotating end 17 of the fiber optic bundle, the output of the light sensitive device 16 will change. Acting in response to the change in the output of light sensitive device 16, the control circuitry will cause clutch 11 to be de-energized. The ability to cause relative motion between the end 17 of the fiber optic bundle and the register marks on web 5 results from incorporation of the one-way clutch mechanism including freewheel 13 in the drive train for the smaller diameter roller 2.

As will be obvious to those skilled in the art from the above discussion, in accordance with the present invention the distance between the desired and actual positions of the register marks does not have to be measured, i.e., unlike the prior art the present invention does not require sophisticated circuitry for making a time comparison. In the present invention the maintenance of position is achieved through the energization and de-energization of the clutch 11.

If the length of the portions to be severed from web 5 is short, the circumferences of the feed rollers 1 and 2 may be adapted to a multiple of the register mark spacing. This will permit a feed correction for every second or third portion. In this case the difference between the register mark spacing and the circumference of feed roller 2 will be made correspondingly smaller.

Conversely, if the length of the portions to be cut from web 5 are comparatively long, the circumference of the rollers 1 and 2 may be adapted to, for example, one-half the register mark spacing whereby a correction will be made only for every second rotation.

While it would be possible to mount the light sensitive device in disc 14 so as to rotate with roller 2, this would necessitate a commutator-type arrangement which is not required when employing the optical fibers 15.

It is to be understood that the present invention is not limited to the embodiment described and shown herein, which is deemed to be merely illustrative of the best mode of carrying out the invention, and which is susceptible of modification of form, size, arrangement of parts and details of opeation. The invention rather is intended to encompass all such modifications which are within its spirit and scope as defined by the claims.

What is claimed is:

1. Apparatus for feeding a web of material provided with register marks comprising:

feed means, said feed means comprising a pair of cooperating and counter-rotating rollers;

light responsive sensor means, said sensor means being at least in part mounted for rotation with one of said rollers, said sensor means being positioned so as to present a test point juxtapositioned to a web of material passing over the said one roller, said sensor means providing output signals commensurate with registration and non-registration of said test point with a register mark; and means responsive to signals provided by said sensor means for producing an adjustment in the relative angular position of said rollers to vary the speed of the web whereby the position of a register mark on the web of material may be caused to move relative to said test point.

2. Apparatus for feeding a web of material provided with register marks comprising:

feed means, said feed means comprising a pair of cooperating and counter-rotating rollers;

a stationary light-sensitive device;

a bundle of optical fibers extending from a position adjacent said light-sensitive device to a test point juxtapositioned to a web of material passing over one of said rollers, said bundle of optical fibers rotating with said one roller, the position of the end of said bundle of fibers which is adjacent to said light-sensitive device remaining unchanged during such rotation, said sensor means providing output signals commensurate with registration and non-registration of said test point with register marks on the web of material; and means responsive to signals provided by said light sensitive device producing an adjustment in the relative angular position of said rollers whereby the position of a register mark on the web of material may be caused to move relative to said test point.

3. The apparatus of claim 1 wherein the web of material partly extends around said one roller and passes between said rollers.

4. The apparatus of claim 2 wherein the web of material partly extends around said one roller and passes between said rollers.

5. Apparatus for feeding a web of material provided with register marks comprising:

feed means, said feed means comprising a pair of cooperating and counter-rotating rollers, the circumference of one of said rollers being less than the register mark spacing on the web and the circumference of the other of said rollers being greater than the register mark spacing on the web;

sensor means, said sensor means being at least in part mounted for rotation with one of said rollers, said sensor means being positioned so as to prevent a test point juxtapositioned to a web of material passing over the said one roller, said sensor means providing output signals commensurate with registration and non-registration of said test point with register marks on the web; and means responsive to signals provided by said sensor means for producing an adjustment in the angular position of said other of said rollers relative to said one roller whereby the position of a register mark on the web of material may be caused to move relative to said test point.

6. The apparatus of claim 2 wherein the circumference of said one roller is less than the register mark spacing on the web and the circumference of the other of said rollers is greater than the register mark spacing on the web, said adjustment producing means operating directly on said other of said rollers.

7. The apparatus of claim 3 wherein the circumference of said one roller is less than the register mark spacing on the web and the circumference of the other of said rollers is greater than the register mark spacing on the web, said adjustment producing means operating directly on said other of said rollers.

8. The apparatus of claim 4 wherein the circumference of said one roller is less than the register mark spacing on the web and the circumference of the other of said rollers is greater than the register mark spacing on the web, said adjustment producing means operating directly on said other of said rollers.

9. The apparatus of claim 2 wherein said one of said rollers is mounted for rotation with a driven shaft and wherein said light-sensitive device is coaxial with said shaft and adjacent an end thereof, said fiber optic bundle in part extending along an axial bore in said shaft and in part extending generally radially outward from said axial bore to the text point adjacent the periphery of the said one of said rollers.

10. The apparatus of claim 6 wherein said one of said rollers is mounted for rotation with a driven shaft and wherein said light-sensitive device is coaxial with said shaft and adjacent an end thereof, said fiber optic bundle in part extending along a axial bore in said shaft and in part extending generally radially outward from said bore to the test point adjacent the periphery of the said one of said rollers.

11. The apparatus of claim 8 wherein said one of said rollers is mounted for rotation with a driven shaft and wherein said light-sensitive device is coaxial with said shaft and adjacent an end thereof, said fiber optic bundle extending along an axial bore in said shaft and generally radially outward from said bore to said test point, said test point being located adjacent the periphery of the said one of said rollers.

12. The apparatus of claim 9 wherein said delivery means further comprises:

a drive shaft;

means mounting said other of said rollers coaxially with said drive shaft; and wherein said adjustment producing means includes:

normally de-energized first clutch means for coupling said other of said rollers to said drive shaft, the state of energization of said first clutch means being controlled by said light-sensitive device output signals.

13. The apparatus of claim 12 wherein said feed means further comprises:

means coupling said driven shaft to said drive shaft; and means mounting said one of said rollers coaxially of said driven shaft; and wherein said adjustment producing means includes:

one-way clutch means for coupling said driven shaft to said one of said rollers.

14. The apparatus of claim 13 wherein said first clutch means comprises a magnetic clutch.

15. The apparatus of claim 13 wherein the circumference of said one roller is less than the register mark spacing on the web and the circumference of the other of said rollers is greater than the register mark spacing on the web, said adjacent producing means operating directly on said other of said rollers.

16. The apparatus of claim 15 wherein said first clutch means comprises a magnetic clutch.

17. The apparatus of claim 5 wherein said feed means further comprises:

a drive shaft;

means mounting said one of said rollers for rotation with and about said driven shaft;

a drive shaft;

means mounting said other of said rollers for rotation with and about said drive shaft; and means drivingly coupling said drive shaft to said driven shaft.

18. The apparatus of claim 17 wherein said adjustment producing means comprises:

first normally de-energized clutch means, said normally de-energized clutch means coupling said other of said rollers to said drive shaft when energized, said normally de-energized clutch means being energized by output signals provided by said sensor means and indicative of a lack of registration; and one-way clutch means, said one-way clutch means drivingly coupling said driven shaft to said one of said rollers, said one-way clutch means permitting said one of said rollers to exceed the speed of rotation imparted thereto by rotation of said driven shaft.

19. The apparatus of claim 18 wherein said sensor means comprises:

a stationary light-sensitive device; and a bundle of optical fibers extending from a position adjacent said light-sensitive device to said test point, said bundle of optical fibers rotating with said one roller, the position of the end thereof which is adjacent said light-sensitive device remaining unchanged during such rotation.

20. The apparatus of claim 13 wherein said first clutch means comprises a magnetic clutch.

* * * * *